US008201348B2

(12) United States Patent
Kelly

(10) Patent No.: US 8,201,348 B2
(45) Date of Patent: Jun. 19, 2012

(54) STUDDED FOOTWEAR

(75) Inventor: Paul Andrew Kelly, Warwickshire (GB)

(73) Assignee: Softspikes, LLC, Brentwood, TN (US)

( * ) Notice: Subject to any disclaimer, the term of this patent is extended or adjusted under 35 U.S.C. 154(b) by 1466 days.

(21) Appl. No.: 11/610,114

(22) Filed: Dec. 13, 2006

(65) Prior Publication Data

US 2007/0209239 A1 Sep. 13, 2007

Related U.S. Application Data

(60) Provisional application No. 60/782,677, filed on Mar. 16, 2006.

(30) Foreign Application Priority Data

Dec. 16, 2005 (GB) ..... 0525589.8

(51) Int. Cl.
*A43B 5/00* (2006.01)
*A43C 15/16* (2006.01)

(52) U.S. Cl. ..... 36/134; 36/65; 36/67 D

(58) Field of Classification Search ..... 36/59 R, 36/62, 67 D, 37 A, 134, 65; 403/350–352, 403/349

See application file for complete search history.

(56) References Cited

U.S. PATENT DOCUMENTS

| | | | | |
|---|---|---|---|---|
| 5,123,184 | A * | 6/1992 | Ferreira | 361/34 |
| 5,321,901 | A * | 6/1994 | Kelly | 36/134 |
| 5,768,809 | A * | 6/1998 | Savoie | 36/134 |
| 6,708,428 | B2 * | 3/2004 | Chen | 36/134 |
| 6,823,613 | B2 * | 11/2004 | Kelly et al. | 36/134 |
| 7,007,413 | B2 * | 3/2006 | McMullin | 36/134 |

FOREIGN PATENT DOCUMENTS

| | | | |
|---|---|---|---|
| EP | 1723865 | A1 | 11/2008 |
| WO | 9115131 | A1 | 10/1991 |
| WO | 0239840 | A1 | 5/2002 |

* cited by examiner

*Primary Examiner* — Khoa Huynh
*Assistant Examiner* — Sharon M Prange
(74) *Attorney, Agent, or Firm* — Edell, Shapiro & Finnan, LLC

(57) ABSTRACT

A shoe stud and receptacle, the shoe stud including a ground-engaging part and the two components are adapted to be secured together by a multi-start threaded connection comprising a screw-threaded spigot on one of the two components adapted to be inserted with rotation into a screw-threaded socket on the other component, and a locking means of the components which is arranged to become interengaged to resist unscrewing of the assembly, the locking means comprising a primary locking means and at least one secondary locking member, the primary locking means comprising a ring of posts extending axially from one of the components and a ring of teeth on the other component, the posts engaging between the teeth, and wherein the or each secondary locking member is adapted to engage with a post to maintain the interengagement of the primary locking means.

25 Claims, 8 Drawing Sheets

STUDDED FOOTWEAR

CROSS REFERENCE TO RELATED APPLICATIONS

This application is a nonprovisional of U.S. Provisional Application 60/782,677 filed 16 Mar. 2006 and entitled "Studded Footwear", as well as claims priority under 35 U.S.C. §§119 and/or 365 to GB patent application 0525589.8, filed 16 Dec. 2005 and entitled "Studded Footwear". The disclosures of the aforementioned documents are incorporated herein by reference in their entireties.

This invention relates to studded footwear such as sports shoes, for example football boots and golf shoes or shoes for other sports or activities that are played or performed on turf. The term 'football' is intended to encompass all sports known as football, such as soccer, rugby and American and Australian football.

The studs are intended to provide traction, having a ground-engaging part of a type suited to the sport involved. The studs are detachably fastened to the sole of the article of footwear, by a screw-threaded spigot on the stud engaging in a correspondingly threaded socket in a receptacle molded in, or otherwise secured to, the shoe sole.

The screw-threaded connection must be designed to ensure that the stud remains in place, even when high forces are applied, and in particular that it does not unscrew accidentally. Known studs have either a single start thread or a multi-start thread. A single start thread is the simplest thread form, and provides a greater resistance to unscrewing than a multi-start thread. It also provides a strong connection over the several turns of the thread on the spigot and socket. However, because of the number of turns needed to attach and detach the stud, removal and replacement becomes a time-consuming operation. A multi-start thread has a steeper helix angle, which enables a spigot of any given length to be inserted into the socket with less rotation. Also, because a multi-start thread is deeper cut than a single start thread, the shear strength of the thread is greater, so that a shorter spigot can be used.

Whether a single start or multi-start thread is used, the studs and sockets also incorporate a locking ratchet to prevent accidental unscrewing of the studs. Typically, the stud and socket each have a set of teeth, which interengage as the stud is inserted into the socket. The arrangement of the teeth allows the stud to be in any one of a number of positions relative to the socket when it is fully inserted. The screw threads and locking ratchets described are quite adequate where the rotational orientation of the stud relative to the sole is not significant.

However, in some sports where the forces on the studs are relatively high and of a particular type, such as lateral forces or forces due to rapid forward acceleration of the wearer of the shoe, studs which are specifically oriented can be more effective. (The term "specifically-oriented stud" will be used to include studs which are non-rotationally symmetrical, or studs which are rotationally symmetrical, but whose orientation relative to the shoe sole is significant.) A specifically-oriented studs must be oriented very precisely (i.e. in a single unique orientation) relative to the shoe sole to ensure that it operates in the desired manner.

Screw-threads and locking ratchets have been developed to provide this precise orientation. In WO 02/39840 a locking means is disclosed that comprises a radial projection on the stud that engages with a lead-in ramp, recess and stop means on the receptacle. This locking means is adapted to ensure a specific orientation of the stud relative to the receptacle when they are screwed together. However, this locking means may not provide a sufficiently secure connection or adequate resistance to unscrewing for all applications.

According to a first aspect of the present invention, in a combination of a shoe stud and receptacle, the shoe stud includes a ground-engaging part and the two components are adapted to be secured together by a multi-start threaded connection comprising a screw-threaded spigot on one of the two components adapted to be inserted with rotation into a screw-threaded socket on the other component, and a locking means of the components which is arranged to become interengaged to resist unscrewing of the assembly, the locking means comprising a primary locking means and at least one secondary locking member, the primary locking means comprising a ring of posts extending axially from one of the components and a ring of teeth on the other component, the posts engaging between the teeth, and wherein the or each secondary locking member is adapted to engage with a post to maintain the interengagement of the primary locking means.

The engagement of the secondary locking member with the posts of the primary locking means ensures that the primary locking means is secure. Thus, the locking means resists unscrewing of the components and ensures the final orientation of the stud relative to the receptacle is determined. A stud can therefore be specifically oriented relative to the receptacle, and hence to the shoe sole.

The radially inner surface of the posts is typically adapted to engage between the teeth. Preferably the or each secondary locking member is adapted to engage the radially outer surface of at least one post. This promotes the interengagement between the posts and teeth.

Preferably, the at least one secondary locking member is provided on the receptacle and the posts are provided on the stud.

The secondary locking member may comprise a post or a plurality of circumferentially spaced posts arranged in a ring. Preferably the or each secondary locking member engages with the radially outer surface of a corresponding post.

Preferably, the secondary locking member comprises at least one hooked member, the arrangement being such that the at least one hooked member engages and partially surrounds at least one of the posts when the spigot has been screwed into the socket to a predetermined axial position. The hooked member may therefore comprise a radially extending part and circumferentially extending part. The hooked members also have the advantage of providing an indication of locking, as the components cannot be screwed together any further once the post or posts have engaged with the hooked members.

Both the radially and circumferentially extending parts of the hooked members may be adapted to engage a corresponding post. Alternatively, only the circumferentially extending part may be adapted to contact a corresponding post when the stud is fully engaged with the receptacle. The radially extending part may provide a stop, for example, that only engages with a post after a predetermined amount of rotation to prevent over tightening of the threaded connection. Thus, when the stud is fully engaged with the receptacle, only the circumferentially extending part of the hooked member maintains the interengagement of the primary locking means.

Preferably the posts include a projection that is adapted to engage in a notch in the radially inner surface of the hooked members. The projection aids in the interengagement of the posts with the secondary locking member, ensuring a secure connection.

Preferably three secondary locking members are provided. Preferably the secondary locking members are equally circumferentially spaced.

Preferably, six posts are provided arranged in a ring. Thus, if three secondary locking members are provided, they are adapted to engage with every other post.

Preferably, the threaded connection is adapted to ensure that the secondary locking members engage with the same posts. Therefore, only the posts that the secondary locking members are adapted to engage with have the projections.

The multi-start thread may have two, three or more starts, to reduce the number of turns required to attach and detach the stud. In a preferred embodiment the thread is a three-start thread, which enables the stud to be attached in half a turn thereby making removal and attachment easy.

The threaded connection may provide means to determine the initial position of the stud relative to the receptacle by one of the threads and grooves being different from the other or others to provide a key and complementary keyway.

The key may comprise an enlarged thread on one of the components and a correspondingly enlarged groove on the other component. The enlarged thread will only fit in the enlarged groove, thus determining the initial position. Alternatively, the key comprises a bridged thread on one of the components, and a removed thread on the other component. Thus, on the one component the space between the crests of two adjacent threads is filled in, and on the other component the thread between two adjacent roots is removed. This provides the necessary initial orientation of the stud relative to the socket.

Conveniently the key is provided on the receptacle and the keyway on the stud. Alternatively the key could be on the stud and the keyway on the receptacle.

A second aspect of the invention relates specifically to a shoe stud.

According to a second aspect of the invention, a stud for use with an article of studded footwear having a receptacle with a multi-start screw-threaded socket, has a spigot with a multi-start screw thread complementary to the screw thread of the socket, such that rotary insertion of the spigot into the socket secures the stud in the socket, the spigot having one component of a helical key and complementary keyway, of which the other component is provided on the receptacle, the stud having part of a locking means, the locking means comprising a ring of posts extending axially from one of the components and a ring of teeth and at least one secondary locking member on the other component, the arrangement being such that the posts engage between the teeth, and wherein the or each secondary locking member is adapted to engage with a post to maintain the interengagement of the primary locking means.

Preferably the secondary locking member comprises a hooked member that engages and partially surrounds at least one of the posts when the spigot has been screwed into the socket to a predetermined axial position. Preferably the hooked member comprises a radially extending part and a circumferentially extending part.

A third aspect of the invention relates to a receptacle for incorporation in an article of studded footwear, the receptacle being adapted to receive a stud.

According to a third aspect of the invention, a receptacle for incorporation in an article of studded footwear has a multi-start screw-threaded socket adapted to receive a spigot of a shoe stud, the spigot having a multi-start screw thread complementary to the screw thread of the socket, such that rotary insertion of the spigot into the socket secures the stud in the receptacle, the receptacle having one component of a helical key and complementary keyway of which the other component is provided on the spigot, the receptacle having part of a locking means, the locking means comprising a ring of posts extending axially from one of the components and a ring of teeth and at least one secondary locking member on the other component, the arrangement being such that the posts engage between the teeth, and wherein the or each secondary locking member is adapted to engage with a post to maintain the interengagement of the primary locking means.

According to a fourth aspect of the invention, in a combination of a shoe stud and receptacle, the shoe stud includes a ground-engaging part and the two components are adapted to be secured together by a multi-start threaded connection comprising a screw-threaded spigot on one of the two components adapted to be inserted with rotation into a screw-threaded socket on the other component, and a locking means of the components which is arranged to become interengaged to resist unscrewing of the assembly, the locking means comprising a ring of posts extending axially from one of the components and a ring of teeth on the other component, the ring of the posts engaging between the teeth, and at least one radially extending stop member adapted to form a stop for a corresponding post when the assembly is fully interengaged.

The radially extending stop member ensures that the assembly is robust as it provides a definite stop to ensure that the stud and receptacle are sufficiently engaged. The stop member provides additional resilience to over tightening which could otherwise over-stress the thread, for example.

Preferably, the ring of posts has at least one gap therein to receive the at least one radially extending stop member, the stop member being adapted to extend at least partially through the gap at least when the assembly is fully interengaged.

Preferably the stop member extends radially outwardly from the ring of teeth. Preferably the stop member extends adjacent a recess formed between the teeth.

Preferably the stop member abuts the corresponding post when the stud and receptacle are fully interengaged.

Three stop members may be provided. Preferably, the stop members are equally circumferentially spaced. Preferably the ring of posts have gaps at appropriate locations to receive the stop members.

Preferably, six posts are provided arranged in a ring. Thus, if three stop members are provided, they are adapted to engage with every other post.

Preferably, the threaded connection is adapted to ensure that the stop members engage with the same posts.

The multi-start thread may have two, three or more starts, to reduce the number of turns required to attach and detach the stud. In a preferred embodiment the thread is a three-start thread, which enables the stud to be attached in half a turn thereby making removal and attachment easy.

The threaded connection may provide means to determine the initial position of the stud relative to the receptacle by one of the threads and grooves being different from the other or others to provide a key and complementary keyway.

The key may comprise an enlarged thread on one of the components and a correspondingly enlarged groove on the other component. The enlarged thread will only fit in the enlarged groove, thus determining the initial position. Alternatively, the key comprises a bridged thread on one of the components, and a removed thread on the other component. Thus, on the one component the space between the crests of two adjacent threads is filled in, and on the other component the thread between two adjacent roots is removed. This provides the necessary initial orientation of the stud relative to the socket.

Conveniently the key is provided on the receptacle and the keyway on the stud. Alternatively the key could be on the stud and the keyway on the receptacle.

Preferably, the radially extending stop member includes a circumferentially extending part that engages with the corresponding post to maintain the interengagement of the locking means. The stop member and circumferential part may be in the form of a hooked member. The hooked member may include a notch that is adapted to engage a projection on the corresponding post. The engagement of the notch and projection increases the resistance to unscrewing of the stud and receptacle.

A fifth aspect of the invention relates specifically to a shoe stud.

According to a fifth aspect of the invention, a stud for use with an article of studded footwear having a receptacle with a multi-start screw-threaded socket, has a spigot with a multi-start screw thread complementary to the screw thread of the socket, such that rotary insertion of the spigot into the socket secures the stud in the socket, the spigot having one component of a helical key and complementary keyway, of which the other component is provided on the receptacle, the stud having part of a locking means which is arranged to become interengaged to resist unscrewing of the stud from the receptacle, the locking means comprising a ring of posts extending axially from one of the components and a ring of teeth on the other component, the ring of the posts engaging between the teeth, and at least one radially extending stop member adapted to form a stop for a corresponding post when the assembly is fully interengaged.

Preferably the secondary locking member comprises a hooked member that engages and partially surrounds at least one of the posts when the spigot has been screwed into the socket to a predetermined axial position.

A sixth aspect of the invention relates to a receptacle for incorporation in an article of studded footwear, the receptacle being adapted to receive a stud.

According to a sixth aspect of the invention, a receptacle for incorporation in an article of studded footwear has a multi-start screw-threaded socket adapted to receive a spigot of a shoe stud, the spigot having a multi-start screw thread complementary to the screw thread of the socket, such that rotary insertion of the spigot into the socket secures the stud in the receptacle, the receptacle having one component of a helical key and complementary keyway of which the other component is provided on the spigot, the receptacle having part of a locking means which is arranged to become interengaged to resist unscrewing of the stud from the receptacle, the locking means comprising a ring of posts extending axially from one of the components and a ring of teeth on the other component, the ring of the posts engaging between the teeth, and at least one radially extending stop member adapted to form a stop for a corresponding post when the assembly is fully interengaged.

According to a seventh aspect of the invention, a stud for use with an article of studded footwear having a receptacle with a multi-start screw-threaded socket, has a spigot with a multi-start screw thread complementary to the screw thread of the socket, such that rotary insertion of the spigot into the socket secures the stud in the socket, the spigot having one component of a helical key and complementary keyway, of which the other component is provided on the receptacle, the stud having part of a locking means, the locking means comprising a ring of posts extending axially from one of the components and a ring of teeth on the other component, the posts being adapted to engage between the teeth, wherein the ring of posts is mounted on a separate member that is adapted to be secured to the stud.

According to an eighth aspect of the invention, we provide a stud including a spigot having a multi-start screw thread, the spigot having one of either a helical key or complementary keyway, the stud having a ring of posts extending axially from it, the ring of posts being radially spaced from the spigot, the posts having a radially outer face, wherein at least one of the posts has a projection on its radially outer face.

According to a ninth aspect of the invention, we provide a stud including a spigot having a multi-start screw thread, the spigot having one component of either a helical key or complementary keyway, the stud having a ring of posts extending axially therefrom, the ring of posts comprising first posts and second posts, wherein the first posts have a substantially smaller axial height than the second posts.

This makes manufacture of the stud easy and provides a robust locking means.

Preferably, at least one of the posts is inclined in axial height. The aids in the coupling of the stud and receptacle as described below.

The various aspects of the invention are illustrated, by way of example only, in the accompanying drawings, in which.

Figure 1:
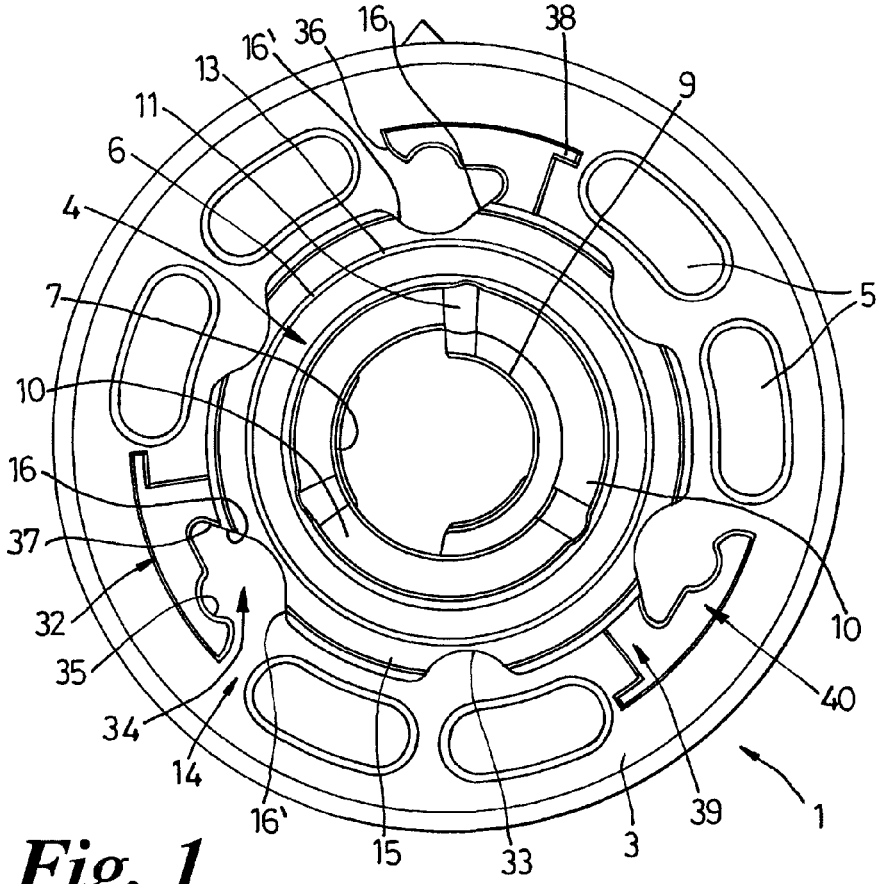
FIG. 1 is a plan view of a first embodiment of a receptacle.
Figure 2:
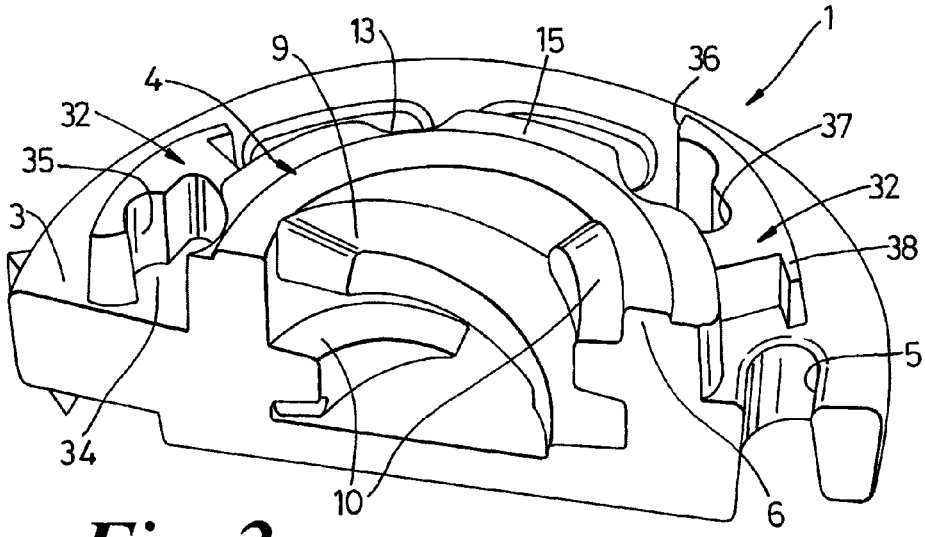
FIG. 2 is a perspective view of a section through the receptacle of FIG. 1.
Figure 3:
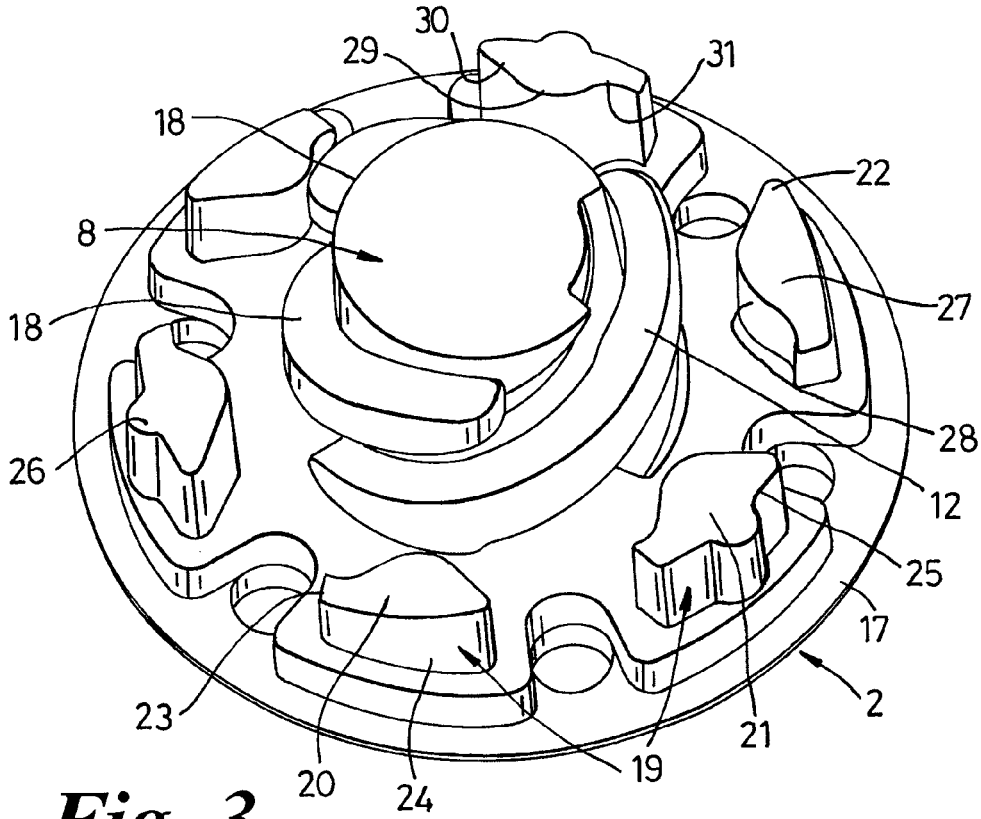
FIG. 3 is a perspective view of a first embodiment of a stud.
Figure 4:
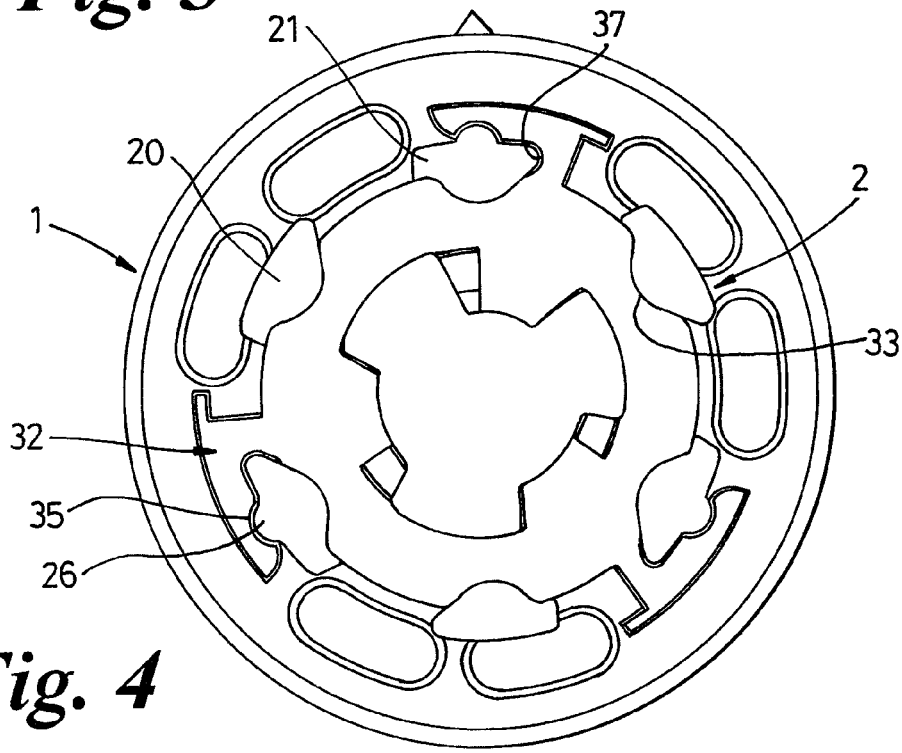
FIG. 4 shows a section through the stud of FIG. 3 and receptacle of FIG. 1 when they are engaged together.

FIGS. 1 and 2 show a receptacle 1, which is molded into or otherwise attached to a sole or heel of the sports shoe such as a golf shoe, (not shown). A stud 2 is shown in FIG. 3 and is adapted to be inserted with rotation into the receptacle 1, as shown in FIG. 4. The receptacle 1 and stud 2 have corresponding parts of a primary locking means 14 and secondary locking member 32 to secure them together The receptacle 1 of FIGS. 1 and 2 is a unitary molding of plastics material. It has a circular top plate 3 with a central boss 4 depeading from it. The receptacle 1 is adapted to be incorporated in the sole or heel of a golf or other sports shoe, normally by molding. The receptacle 1 is anchored in the shoe sole or heel by the top plate 3, which includes perforations 5 to assist in this.

The boss 4 has a stout cylindrical wall 6, whose inside forms an internally screw-threaded socket 7 adapted to receive a spigot 8 of the stud 2. The socket 7 has a three-start thread, with one of threads 9 being enlarged radially in relation to the other two 10. The radially outer surface 13 of the wall 6 is formed with part of the primary locking means 14, as a ring of axially extending teeth 15, projecting radially outwards from the surface 13. The teeth 15 are in the form of ribs which extend in a direction parallel to the axis of the socket 7. The teeth 15 have rounded edges 16, 16' and are uniformly distributed about the socket axis, there being six teeth in the embodiment shown. Thus, recesses 33 are defined between the teeth 15, where the wall 6 forms the base of the recess 33.

The receptacle 1 also includes the secondary locking members in the form of hooked members 32. Three hooked members 32 are shown projecting from alternate teeth 15 around the boss 4. The hooked members 32 comprise substantially L-shaped projections that extend first radially from the edges 16 of the teeth 15 and then circumferentially to substantially circumferentially align with the end of the recesses 33, defined by the opposed edge 16'. Thus, the hooked members 32 include a radial part 39 and a circumferential part 40 which, with the recess 33, define a locking recess 34. The hooked members 32 also have notches 35 facing the recesses 33. The notches 35 comprise an axial groove in the inwardly facing surface of the circumferential part 40. The free ends of the circumferential part 40 have a curved lead-in surface 36 that is include towards the locking recess 34. The hooked members 32 also include an extension portion 38 which extends from the junction between the radial part 39 and circumferential part 40 in a circumferential direction, opposite to the direction in which the circumferential part 40 extends. The extension portion 38 adds to the resilience of the hooked members 32 and provides additional stability in both a radial and circumferential direction.

The stud 2, shown in FIG. 3, is adapted to be inserted with rotation and received in a receptacle 1, shown in FIGS. 1 and 2. The stud 2 is a unitary molding of plastics material, with a circular flange 17. The lower side of the flange 17 is provided with a ground-engaging formation (not visible).

The spigot 8 projects from the upper side of the flange 17 and has an external screw thread. The external screw thread on the spigot 8 is a three-start thread, with a relatively steep helix angle, so that the stud 2 can be inserted in the receptacle 1 in half a turn. The external thread on the stud 2 includes an enlarged groove 12. The groove 12 is deeper in the radial direction than the other two 18, to complement the enlarged thread 9 on the screw-thread of the receptacle 1. The thread 9 and groove 12 form a key and keyway to ensure the stud 2 and receptacle 1 can only be screwed together in a specific orientation thereby defining the initial position of the stud 2 relative to the receptacle 1.

The stud 2 has the other part of locking means 14, which secures the stud 2 in the receptacle 1, and defines its final position relative to the receptacle. The locking means 14 on the stud 2 comprises a ring of resilient posts 19, which are adapted to engage between the ring of teeth 15 on the receptacle 1.

The resilient posts 19 extend axially from the upper side of the flange 17. The posts 19 surround the spigot 8, and form a ring concentric with the spigot 8. The posts 19 comprise two types, three first posts 20 and three second posts 21. The first and second posts 20, 21 are distributed alternately around the spigot 8 and all are radially resilient.

The axial extent of each post 19 is about half the axial height of the spigot 8, although the first posts 20 are inclined in axial height. Thus, the first posts 20 have a leading edge 22 and a trailing edge 23, with respect to the direction of insertion of the stud into the receptacle, where the trailing edge 23 is lower in axial height than the leading edge 22. The radially outer surface 24 of the first posts 20 is arcuate, while the outer surface 25 of the second posts 21 is also arcuate but has a radially extending rounded projection 26. The projection 26 extends axially the full height of the second posts 21. A top surface 27 of all the posts 19 is angled up towards the spigot 8, so that a radially inner surface 28 of each post 19 has greater axial height than the outer surface 24. The radially inner surface 28 of each post 19 is generally convex towards the spigot 8, with a central convex region 29, a first circumferential end 30 having a substantially straight profile towards the spigot 8, and a second circumferential end 31 having a steep concave profile towards the spigot 8. It will be appreciated that although the end 30 is shown having a straight profile, it could also be concave. The first end 30 is the leading end and the second end 31 the trailing end on insertion of the stud 2, and vice versa when it is removed. The concave profile of the first end 30 presents less resistance on insertion of the stud 2, while the profile of the second end 31 presents greater resistance on removal.

The distance of radial projection of the teeth 15 from the socket axis is substantially equal to that of the radially inner surfaces of the posts 19 at the first circumferential end 30. Thus, there is radial interference between the teeth 15 and the posts 19, which causes frictional resistance to relative rotation of the stud 2 and the receptacle 1.

The stud 2 is installed by the insertion of the spigot 8 into the socket 4. Because of the enlarged thread 9 and enlarged groove 12 there is only one position in which the threads on the spigot 8 and socket 4 can start to engage. Rotation of the stud 2 causes the spigot 8 to be drawn into the socket 4, and as the spigot 8 is screwed in, the teeth 15 begin to engage with the posts 19. Rotation is resisted by engagement of the teeth 15 with successive posts 19. As the teeth 15 are substantially incompressible, the posts 19 deflect radially in a resilient manner, to allow the teeth 15 to move past the posts 19. The profile of the radially inner surface of the posts 19 allows relatively easy movement of the teeth 15 past the posts 19, although as the spigot 8 goes further into the socket 4, the posts 19 are less easily deflected.

The axial height of the posts 19 and the hooked members 32 are such that at the beginning of insertion of the spigot 8 into the socket 4, the first posts 20 pass over the hooked members 32. However, as the spigot 8 and socket 4 are drawn together toward becoming fully engaged, the separation between the posts 19 and hooked members 32 in the axial direction decreases. The first posts 20 are able to clear the hooked members 32 during this final stage of interengagement due to their inclined top surfaces 27. Thus, the difference in axial height between the leading edge 22 and the trailing edge 23 corresponds to the change in axial separation between the posts 20 and the hooked members 32 caused by the spigot 8 engaging with, and being screwed into, the socket 4.

Upon further rotation of the spigot 8 relative to the socket 4, the second posts 21 and the hooked members 32 are of an axial separation to begin to engage. The leading edge 30 of the second posts 21 will first abut the end 36 of the hooked member 32. The hooked member 32 is adapted to deflect radially outwardly in a resilient manner to allow the second post 21 to enter the locking recess 34. Once the post 21 is within the locking recess 34 it abuts a stop 37 of the radial part 39 of the hooked member 32 (shown most clearly in FIG. 4). The hooked member 32 therefore partially surrounds the second post 21. Further, in the engaged position the projection 26 is received within the complementary notch 35, which improves the engagement between the second posts 21 and the hooked members 32. When the second posts 21 are engaged with the hooked members 32, the central convex region 29 of the first posts 20 is engaged with the recesses 33 between teeth 15. Thus, the stud 2 is fully inserted in the receptacle 1, and is secured by the interengagement of the teeth 15 between the first and second posts 20, 21, and by the interengagement of the hooked members 32 with the second posts 21. The hooked members 32 therefore provide radial and circumferential resistance to movement of posts 21 to ensure the stud 2 and receptacle 1 are securely engaged.

Thus, the initial position of the stud 2 relative to the receptacle 1 is determined by the thread 9 and the groove 12. The final position, in this embodiment, is determined by the length of the threads and the locking means 14, wherein the second posts 21 abut the stop 37 of the hooked members 32, thus ensuring that in the final position the stud 2 is precisely oriented relative to the receptacle 1.

Figure 5:
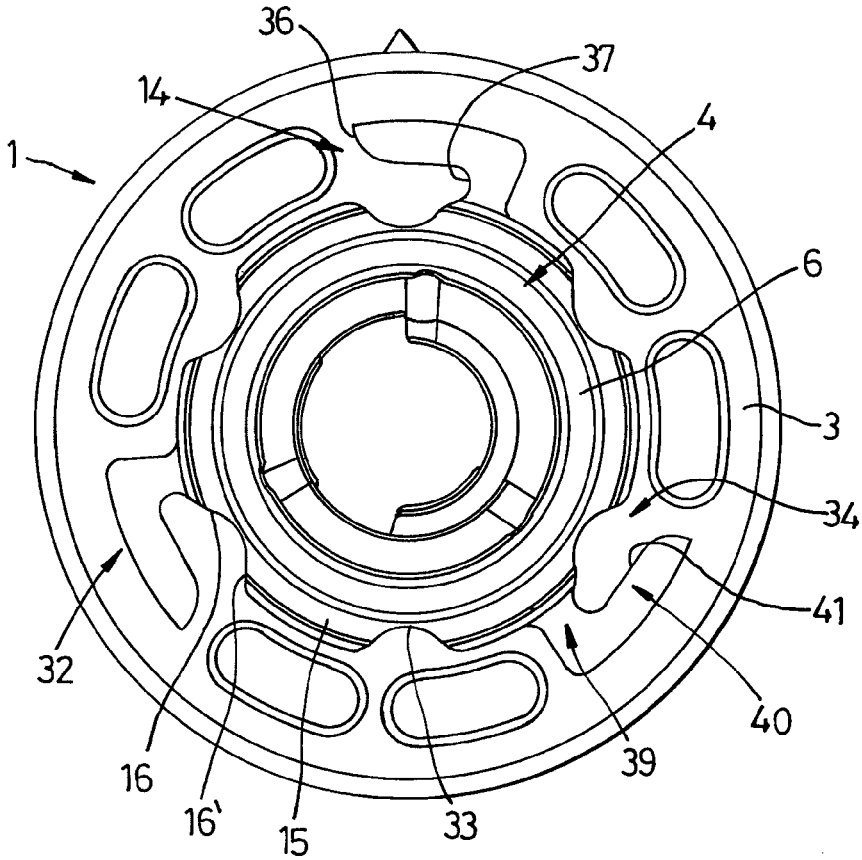
FIG. 5 shows a modification to the secondary locking member on the receptacle.
Figure 6:
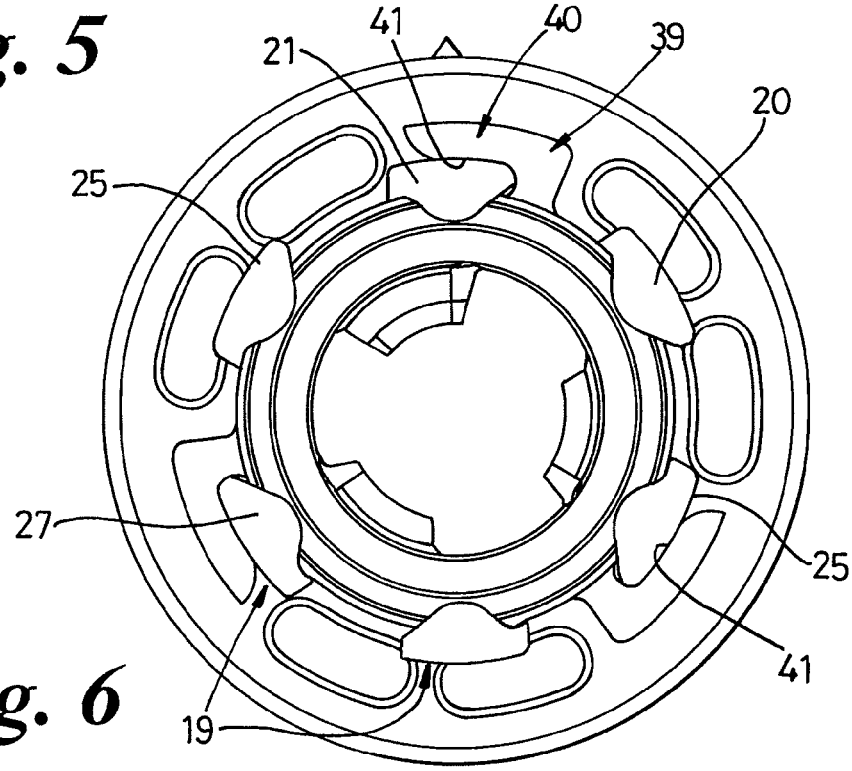
FIG. 6 shows a section through the modified receptacle of FIG. 5 when it is engaged with a stud.

FIGS. 5 and 6 show a first modification to the secondary locking members 32 of the receptacle 1 and to the posts 19 of the stud 2. The remaining features of the receptacle 1 and stud 2 are identical to the previous embodiment and therefore the same reference numerals have been used. In FIG. 5 there are three secondary locking members, substantially identical to the first embodiment, in the form of L-shaped hooked members 32 comprising a radial part 39 and a circumferential part 40. The radial part 39 extends radially outwardly from one of the teeth 15 adjacent an edge 16. The circumferential part 40 extends from the radial part 39 in a circumferential direction in order to form a locking recess 34 between itself and the recess 33, in combination with the radial part 39. The free ends of the circumferential part 40 have a curved lead-in surface 36 that is inclined towards the locking recess 34. However, the first modification is the lack of a notch 35 and therefore the inwardly facing surface 41 of the circumferential part 40 is uninterrupted. The extension portion 38, shown in FIGS. 1 and 2, is also absent in this embodiment. It has been found that, although preferable, the extension portion 38 can be omitted without a detrimental effect on the resilience of the hooked member 32.

FIG. 6 shows a section through the receptacle 1 when it is interengaged with a stud 2, similar to FIG. 4. This Figure shows the modified form of the posts 19 in order for them to engage with the modified secondary locking members 32. The posts 19 comprise first posts 20 and second posts 21, although in section they are identical in shape. Thus, compared to the embodiment shown in FIG. 3, the second posts 21 do not have a radially extending rounded projection 26, as there are no notches for such a projection to engage. Instead, the arcuate outer surface 25 of the second posts 21 simply abuts the inwardly facing surface 41 of the hooked member 32 when the respective parts are interengaged. However, the height and inclination of the top surface 27 of first and second posts 20, 21 will be as described in relation to the first embodiment.

Although the surface 41 of the hooked member is shown in contact with the surface 25 of the second posts 21 when the stud and receptacle are engaged, it will be appreciated that the circumferential part 40 of the secondary locking means could be spaced therefrom. When the assembly is disengaged, the stud 2 is rotated relative to the receptacle 1, which causes the posts 19 to deflect radially outwards as they ride over the teeth 15. Thus, the spacing of the circumferential part 40 may be such that it is adapted to contact the post 21 when the post is deflected radially outwards during disengagement. The hooked member 32 will therefore still provide means to resist unscrewing of the assembly, as it will aid the retention of the posts 21 between the teeth 15. The hooked members 32 provide circumferential and radial resistance to the separation of the primary locking means, although the radial resistance is less than the embodiment of FIG. 4 due to the lack of notch 35.

Figure 7:
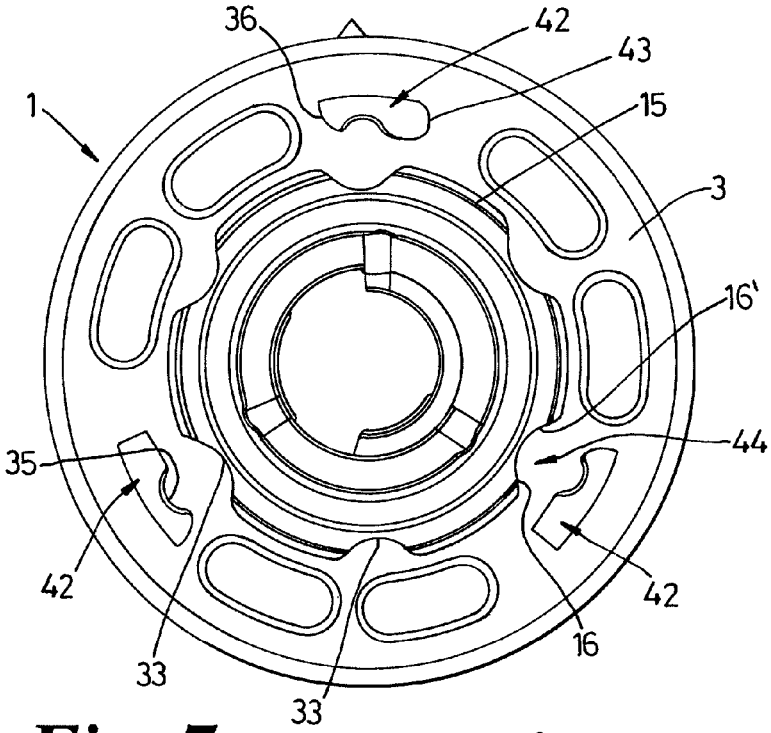
FIG. 7 shows a second modification to the secondary locking member on the receptacle.
Figure 8:
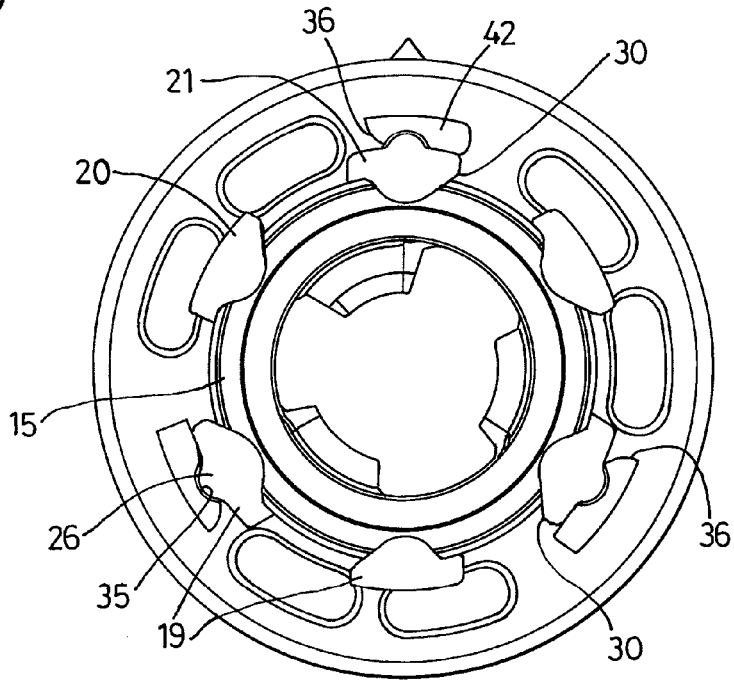
FIG. 8 shows a section through the modified receptacle of FIG. 7 when it is engaged with a stud.

FIGS. 7 and 8 show a second modification of the secondary locking members 32. As with the previous two embodiments, the receptacle 1 is substantially identical and corresponding reference numerals have been used for corresponding parts. However, in this embodiment, the secondary locking member comprises a circumferential locking member 42. The circumferential locking member 42 is of the form of the circumferential part 40 of the hooked locking member shown in FIG. 1. Thus, compared to the first embodiment, the radial part 39 of the booked member 32 has been omitted.

Three circumferential locking members 42 are shown that are equally circumferentially spaced from each other and are each radially spaced from a recess 33. The free ends 36, 43 of each circumferential locking member 42 substantially circumferentially align with respective edges 16, 16' of the recess 33. Thus, the circumferential locking members 42 and the recesses 33 define a locking channel 44. The circumferential locking members 42 also have notches 35 opposite the recesses 33. The notches 35 comprise an axial groove in the inwardly facing surface of the circumferential locking member 42. The end 36 of the circumferential locking members 42 has a curved lead-in surface that is inclined towards the locking channel 44. It should be noted that the embodiment as shown in FIG. 7 does not have an extension portion 38. However, an extension portion 38 could be included which would extend from the end 43 of the circumferential locking member 42 in a circumferential direction.

FIG. 8 shows the embodiment of FIG. 7 engaged with a stud 2. The posts 19 shown in FIG. 8 are identical to those described in relation to the first embodiment. When the receptacle 1 and stud 2 are screwed together, the leading edge 30 of the second posts 21 will first abut the end 36 of the circumferential locking member 42. The circumferential locking member 42 is adapted to deflect radially outwardly in a resilient manner to allow the second post 21 to enter the locking channel 44. The timing of the thread 9, 12 ensures that the stud 2 and receptacle 1 become fully engaged when the post 21 is within the locking channel 44. The circumferential locking member 42 is adapted to restrict the movement of post 21 when the post is deflected radially outwards during disengagement. The circumferential locking member 42 will therefore provide means to resist unscrewing of the assembly, as it will aid the retention of the posts 21 between the teeth 15. The locking member 42 provides radial resistance to movement of the post 21 and some circumferential resistance due to the engagement between projection 26 and notch 35.

Figure 9:
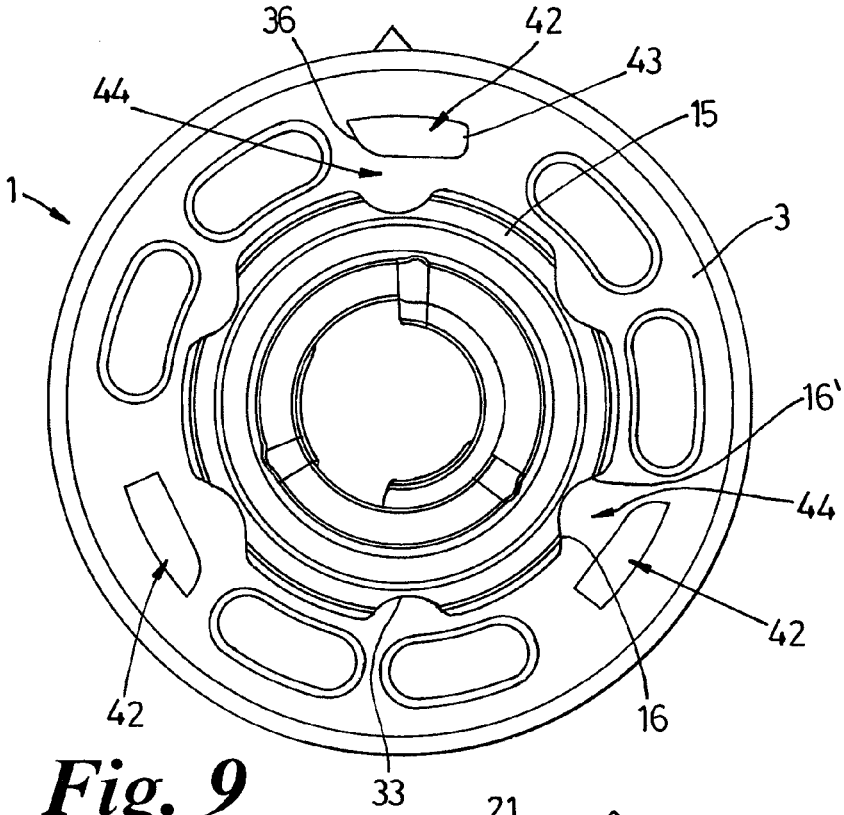
FIG. 9 shows a third modification to the secondary locking member on the receptacle.
Figure 10:
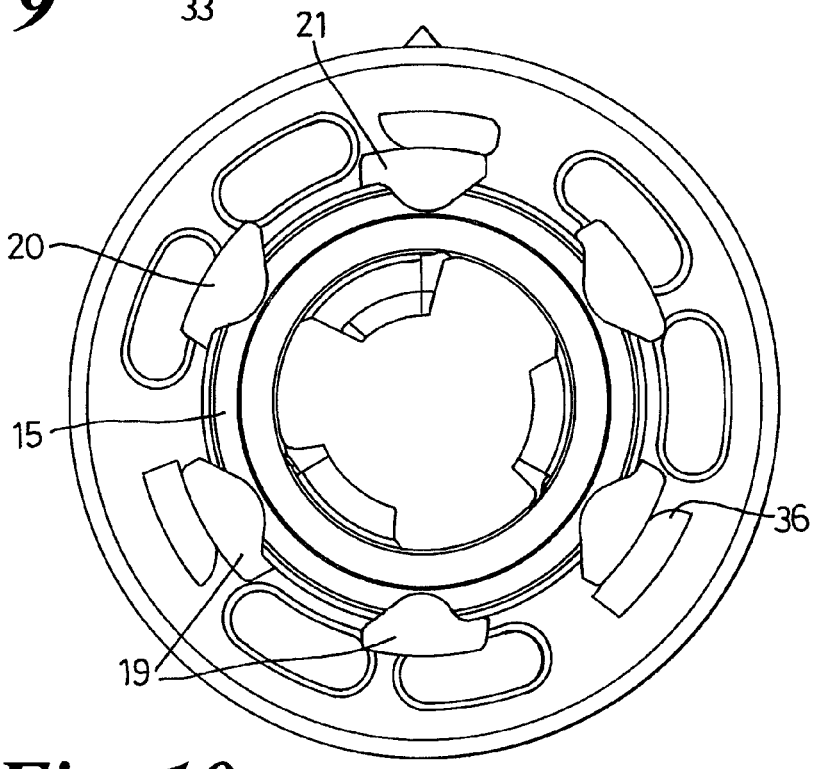
FIG. 10 shows a section through the modified receptacle of FIG. 9 when it is engaged with a stud.

FIGS. 9 and 10 show a modification of the circumferential locking member 42 shown in FIGS. 7 and 8. In this embodiment, the circumferential locking member 42 does not have notches 35. Accordingly, the second posts 21 on the stud 2 do not have the corresponding projections 26. The remainder of the receptacle 1 and stud 2 is identical to the previous embodiment.

As discussed above in relation to the circumferential part 40, the circumferential locking member 42 need not contact the posts 21 when the stud 2 and receptacle 1 are assembled together. The locking member 42 provides radial resistance to movement of the posts 21 and friction between the locking member 42 and the post 21 provides circumferential resistance.

Figure 11:
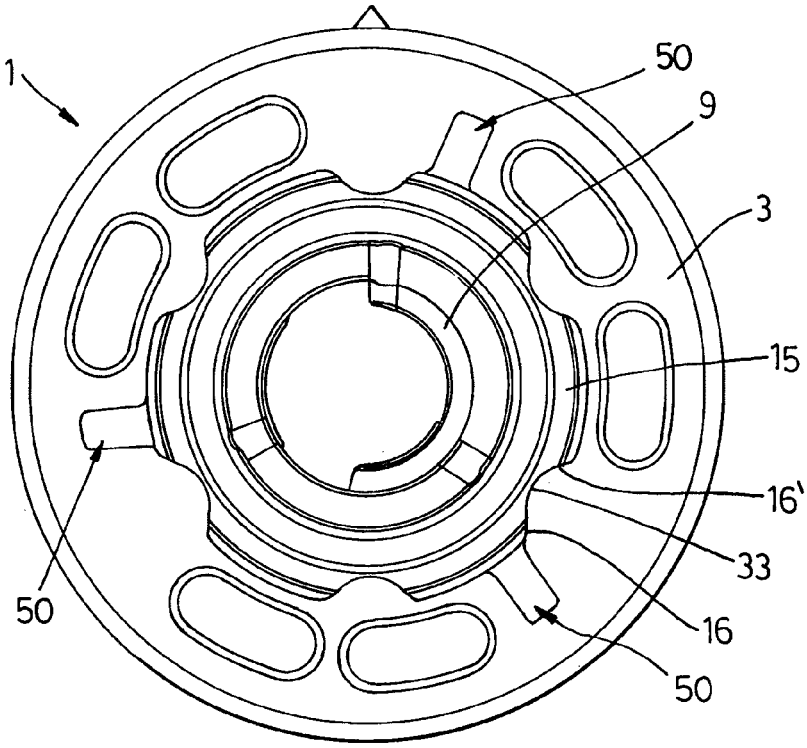
FIG. 11 shows a fourth modification to the secondary locking member on the receptacle.
Figure 12:
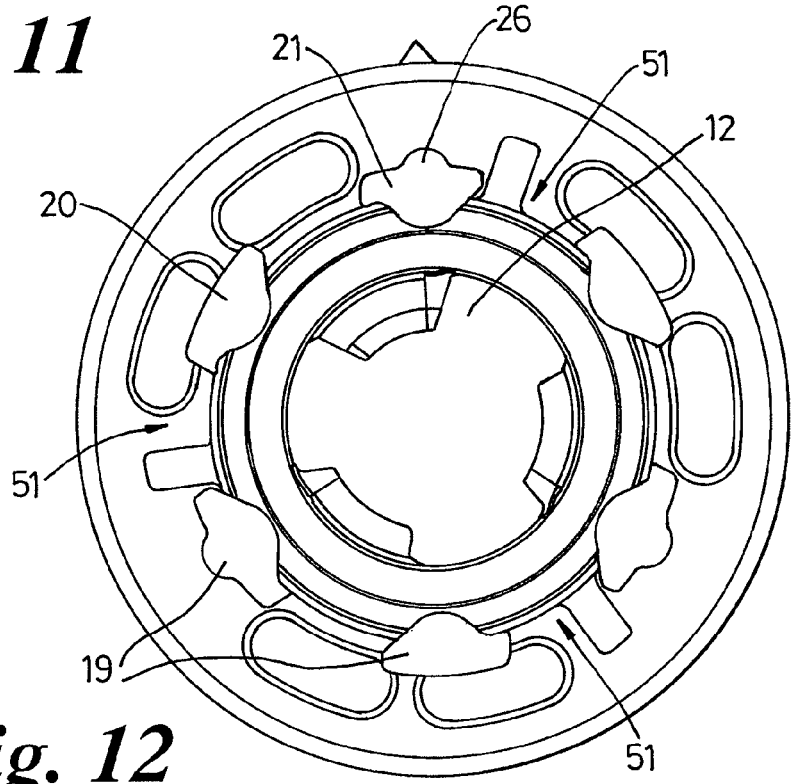
FIG. 12 shows a section through the modified receptacle of FIG. 11 when it is engaged with a stud.

FIGS. 11 and 12 show a fourth modification in which the secondary locking member is replaced with a stop member 50. Three stop members 50 are shown being equally angularly spaced from one another. Each stop member 50 extends radially from one of the teeth 15 adjacent to the edge 16. Thus, in comparison with the first embodiment, the circumferential part 40 of the hooked member 32 has been omitted.

The stop members 50 provide a definite end position when the stud 2 is screwed into the receptacle 1, as the second posts 21 will abut the stop members 50. The stop members 50 also provide additional resilience to over tightening which could otherwise over-stress the thread 9, 12.

As shown in FIG. 12, first and second posts 20, 21 are shown wherein the second posts 21 include the rounded projection 26. As can be appreciated the rounded projection 26 could be omitted and the second posts 21 may have the form described in relation to FIG. 6. Further, the ring of posts 19 has gaps 51 between the posts 19 that receive the stop members 50. The thread 9, 12 is timed and the posts 19 are of an axial height such that the stop members 50 are received within the gaps 51 during the final stages of interengagement of the stud 2 and receptacle 1. Thus, the first posts 20 are able to clear the stop members 50 during this final stage of interengagement due to their inclined top surfaces 27. The stop members 50 are then drawn into gaps 51 upon further rotation and then abut the second posts 21, thereby defining when the stud 2 is fully engaged with the receptacle 1.

Figure 13:
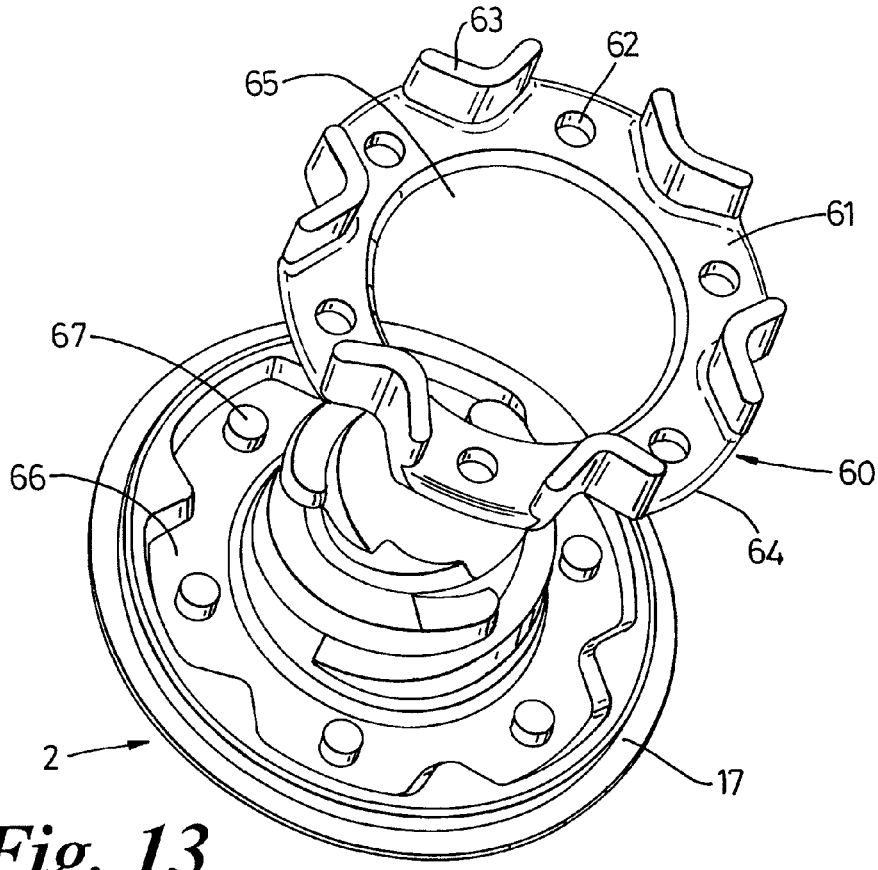
FIG. 13 shows an exploded view of a modification in which the ring of posts on the stud are mounted on a separate component.
Figure 14:
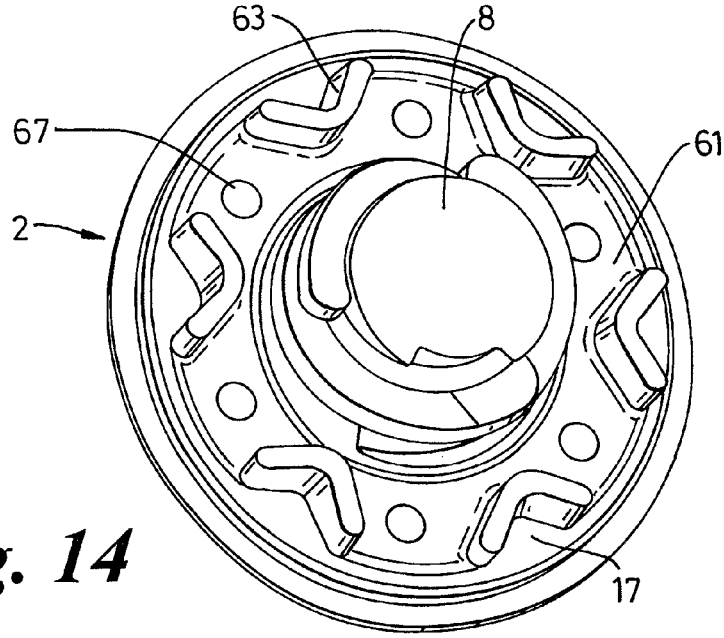
FIG. 14 shows the modification of FIG. 13 when assembled.

FIGS. 13 and 14 show an alternative embodiment of stud 2, in which the ring of posts 19 is mounted on a separate ring member 60. The ring member 60 comprises a base 61 having six apertures 62 extending axially therethrough. The apertures 62 are equally spaced around the ring base 61 and are used to aid in securing the ring 60 to the remainder of the stud 1. The base 61 also has upstanding projections 63 that form the posts. The projections 63 project axially from the base 61 and are V-shaped, wherein the V-shaped posts "point" towards the center of the ring 60. The external edge 64 of the ring 60 has V-shaped notches around it circumference formed by the V-shaped posts 63. The aperture 65 at the center of the ring is adapted to receive the spigot 8 therethrough, when the ring member 60 is mounted on the receptacle 1. The ring member 60 may be of metal or plastics, as appropriate for its intended use.

The circular flange 17 of the stud 2 is also modified to receive the ring member 60. The circular flange 17 has a depressed portion 66 having a profile corresponding to the ring member 60 and a depth that substantially corresponds to the thickness of the base portion 61. The depressed portion also has mounting lugs 67 that project therefrom to be received through the apertures 62, when the ring 60 is mounted to the receptacle. The interengagement of the lugs 67 with the apertures 62 retains the respective parts together.

Figure 15:
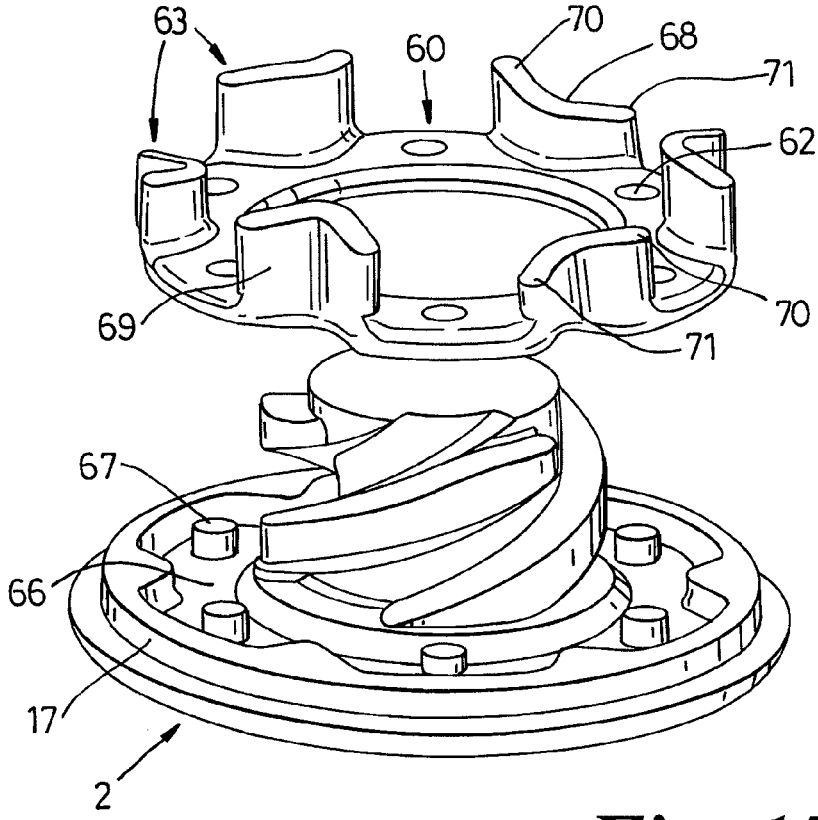
FIG. 15 shows an exploded view of a further modification to the ring of posts shown in FIGS. 13 and 14.
Figure 16:
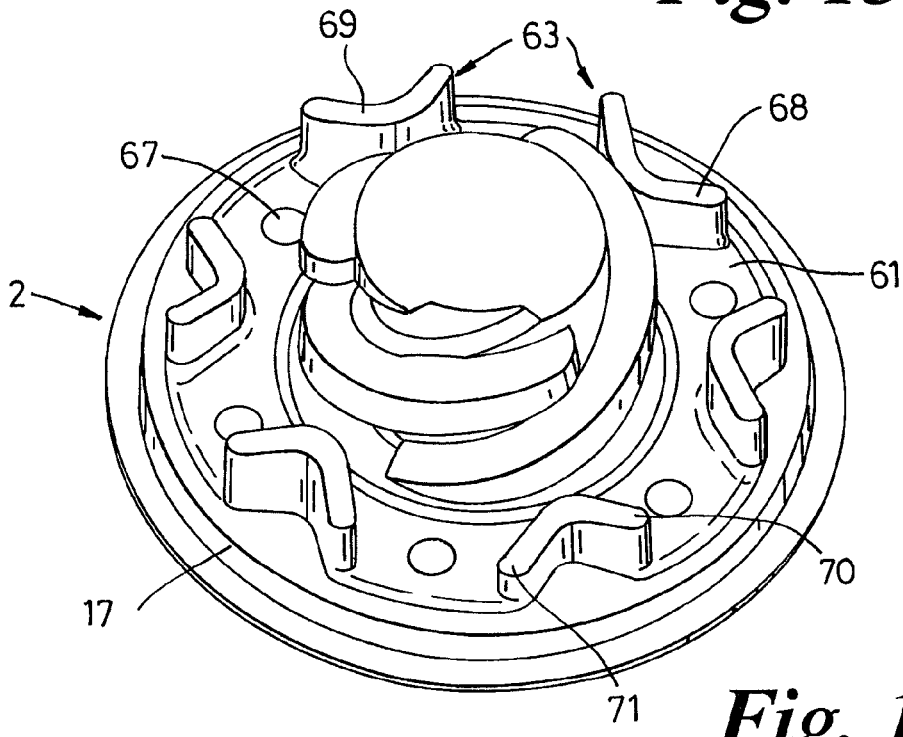
FIG. 16 shows the modification of FIG. 15 when assembled.

The stud 2 of FIGS. 15 and 16 is substantially similar to that shown in FIGS. 13 and 14 and, accordingly, like reference numerals have been assigned to like features. However, in FIGS. 15 and 16, the posts 63 are shown to comprise first posts 68 and second posts 69 as similarly described above. The first posts 68 are inclined in axial height and thus have an inclined top surface 70. Thus, the first posts 68 have a leading edge 71 and a trailing edge 72, with respect to the direction of insertion of the stud 2 into the receptacle 1, where the trailing edge 72 is lower in axial height than the leading edge 71.

The first posts 68 are able to clear the hooked members 32 during this final stage of interengagement due to their inclined top surfaces 70. Thus, the difference in axial height between the leading edge 71 and the trailing edge 72 corresponds to the change in axial separation between the posts 63 and the hooked members 32 caused by the spigot 8 engaging with, and being screwed into, the socket 4.

It will be appreciated that although the posts 63 are shown on a separate member that attaches to the stud, the separate member may be adapted to be received on the circular top plate 3 of the receptacle 1.

The invention claimed is:

1. A combination of a shoe stud and receptacle, the shoe stud includes a ground-engaging part and the two components are adapted to be secured together by a multi-start threaded connection comprising a screw-threaded spigot on one of the two components adapted to be inserted with rotation into a screw-threaded socket on the other component, and a locking means on one of the components which is arranged to become interengaged to resist unscrewing of the assembly, the locking means comprising a primary locking means and at least one secondary locking member, the primary locking means comprising a ring of posts extending axially from one of the components and a ring of teeth on the other component, the posts engaging between the teeth, and wherein the or each secondary locking member projects radially from a surface of said other of the components to engage with a respective post to maintain the interengagement of the primary locking means, wherein the secondary locking member comprises at least one hooked member, the arrangement being such that the at least one hooked member engages and partially surrounds at least one of the posts when the spigot has been screwed into the socket to a predetermined axial position.

2. A combination according to claim 1, in which the hooked member comprises a radially extending part and circumferentially extending part.

3. A combination according to claim 2, in which both the radially and circumferentially extending parts of the hooked members are adapted to engage a corresponding post.

4. A combination according to claim 2, in which only the circumferentially extending part is adapted to contact a corresponding post when the stud is fully engaged with the receptacle.

5. A combination according to claim 2, in which the radially extending part provides a stop that engages with a post after a predetermined amount of rotation.

6. A combination according to claim 1, in which the posts include a projection that is adapted to engage in a notch in a radially inner surface of the hooked members.

7. A combination according to claim 1, in which three secondary locking members are provided and extend axially substantially the full height of said posts.

8. A combination according to claim 1, in which the secondary locking members extend axially substantially the full height of said posts and are equally circumferentially spaced.

9. A combination according to claim 1, in which six of said posts are provided and the secondary locking members extend axially substantially the full height of said posts, and are arranged in a ring.

10. A combination according to claim 1, in which the threaded connection is adapted to ensure that each secondary locking members engages with the same respective posts whenever the primary locking means is interengaged.

11. A combination according to claim 1, in which the multi-start thread has two starts.

12. A combination according to claim 1, in which the multi-start thread has three starts.

13. A combination according to claim 1, in which the threaded connection provides means to determine the initial position of the stud relative to the receptacle by one of the threads and grooves being different from the other or others to provide a key and complementary keyway.

14. A combination according to claim 13, in which the key comprises an enlarged thread on one of the components and a correspondingly enlarged groove on the other component.

15. A combination according to claim 13, in which the key comprises a bridged thread on one of the components, and a removed thread on the other component.

16. A combination according to claim 13, in which the key is provided on the receptacle and the keyway on the stud.

17. A combination of components including a shoe stud and a receptacle, the shoe stud including a ground-engaging part and the two components are adapted to be secured together by a multi-start threaded connection comprising a screw-threaded spigot on one of the two components adapted to be inserted with rotation into a screw-threaded socket on the other component, and a locking means for the components which is arranged to become interengaged to resist unscrewing of the assembly, the locking means comprising a ring of radially inward protruding posts extending axially from said stud and a ring of teeth on said receptacle projecting radially outward from said socket, the ring of the posts engaging radially between the teeth, and at least one radially extending stop member on said receptacle adapted to form a stop for a corresponding post when the assembly is fully interengaged, wherein the radially extending stop member includes a circumferentially extending part that engages with the corresponding post to maintain the interengagement of the locking means, and wherein the stop member and circumferential part are in the form of a hooked member.

18. A combination according to claim 17, in which six posts are provided arranged in a ring.

19. A combination according to claim 17, in which the threaded connection is adapted to ensure that the stop member engages with the same posts whenever the locking means is interengaged.

20. A combination according to claim 17, in which the multi-start thread has three starts.

21. A combination according to claim 17, in which the threaded connection provides means to determine the initial position of the stud relative to the receptacle by one of the threads and grooves being different from the other or others to provide a key and complementary keyway.

22. A combination according to claim 21, in which the key comprises an enlarged thread on one of the components and a correspondingly enlarged groove on the other component.

23. A combination according to claim 21, in which the key comprises a bridged thread on one of the components, and a removed thread on the other component.

24. A combination according to claim 21, in which the key is provided on the receptacle and the keyway on the stud.

25. A combination according to claim 17, in which the hooked member includes a notch that is adapted to engage a projection on the corresponding post.

* * * * *